United States Patent [19]

Trammell et al.

[11] 4,383,775

[45] May 17, 1983

[54] RIBBON SHIELD

[75] Inventors: Kenneth L. Trammell, Campbell, Calif.; Arthur C. Van Horne, Lake Oswego, Oreg.

[73] Assignee: Data Products Corporation, Woodland Hills, Calif.

[21] Appl. No.: 232,902

[22] Filed: Feb. 9, 1981

[51] Int. Cl.[3] ..... B41J 35/28

[52] U.S. Cl. ..... 400/208; 400/248

[58] Field of Search ..... 400/247, 248, 196, 208

[56] References Cited

U.S. PATENT DOCUMENTS

| | | | |
|---|---|---|---|
| 733,851 | 7/1903 | Koch | 400/248 |
| 3,643,777 | 2/1972 | Anderson et al. | 400/242 |
| 4,165,188 | 8/1979 | Rempel | 400/248 |
| 4,325,645 | 4/1982 | Miyajima et al. | 400/208 X |

FOREIGN PATENT DOCUMENTS

| | | | |
|---|---|---|---|
| 197804 | 4/1978 | Fed. Rep. of Germany | 400/249 |

*Primary Examiner*—Richard J. Apley
*Assistant Examiner*—D. J. Isabella
*Attorney, Agent, or Firm*—Spensley, Horn, Jubas & Lubitz

[57] ABSTRACT

An improved ribbon shield for use with a ribbon cassette in a printer. The shield snaps into the front of a ribbon cassette so as to cover an exposed portion of ribbon and prevent the smudging or wicking of ink onto a printing medium. The ribbon shield includes an elongated strip of flexible material such as polypropylene having a central aperture to enable the ribbon to pass through it for printing purposes. The shield includes a lower curved lead-in portion to accommodate paper motion past the cassette. The shield is held within the ribbon cassette in a flexible state. The flexed portion of the shield contacts the printing medium and forces it into close contact with the platen. Improved performance can be obtained by providing spacing ridges in the form of rings which surround the aperture.

8 Claims, 5 Drawing Figures

RIBBON SHIELD

BACKGROUND OF THE INVENTION

1. Field of the Invention

This invention relates to a ribbon shield for use with a ribbon cassette in a printer. More particularly, this invention relates to a ribbon shield for use in a ribbon cassette of the type which contains an endless loop of inked ribbon and which is used in a wire matrix printer.

2. Description of the Prior Art

The use of some type of shield to prevent the smudging or wicking of ink from a ribbon onto a paper in a printing machine is well known. Such shields are disclosed in U.S. Pat. Nos. 398,837 to Loker Jr., 532,211 to Nichols, 733,851 to Koch, 760,371 to Baker, 2,409,237 to Banks and 3,017,981 to Keith. These ribbon shields all perform generally the same function in that they isolate all but a small portion of an inked ribbon from the paper carried in a printing machine such as a typewriter. In the above patents, the ribbon shield is a permanent part of the printing apparatus itself. Therefore, it is subject to the build-up of ink deposits and may require frequent cleanings in order to properly perform its function. In order to alleviate this problem, recent printers which utilize a cassette for carrying the inked ribbon have incorporated a ribbon shield into the cassette rather than the printer mechanism. The shield is thus replaced each time a new ribbon cassette is inserted into the machine. Such ribbon cassettes having integral ribbon shields are disclosed in U.S. Pat. Nos. 3,643,777 to Anderson et al, 3,980,171 to Frechette and 3,941,231 to Matuck. The Matuck patent is directed specifically to a ribbon cartridge for use with a wire matrix printer. In each of these patents, the ribbon shield is secured in a fixed position with respect to the ribbon cartridge. The ribbon shield includes a small opening through which a portion of the ribbon can be forced to accomplish printing.

SUMMARY OF THE INVENTION

The present invention is directed to an improved ribbon shield for use with a ribbon cassette which, although integral with the cassette, is moveable in a direction perpendicular to the plane of the printing medium so as to force the printing medium flat against the platen of the printer. The shield is comprised of an elongated strip of flexible material such as polypropylene having two forwardly angled end portions which are flexed rearwardly and inserted into slots in the housing of the cassette. The ribbon shield is secured against movement in any direction other than perpendicular to the plane of the printing medium. The shield incorporates a rearwardly curved lower portion which provides a smooth lead-in surface for paper in the printer as it passes the ribbon cassette, thereby facilitating paper loading without cassette removal.

DESCRIPTION OF THE PREFERRED EMBODIMENT

Figure 1:
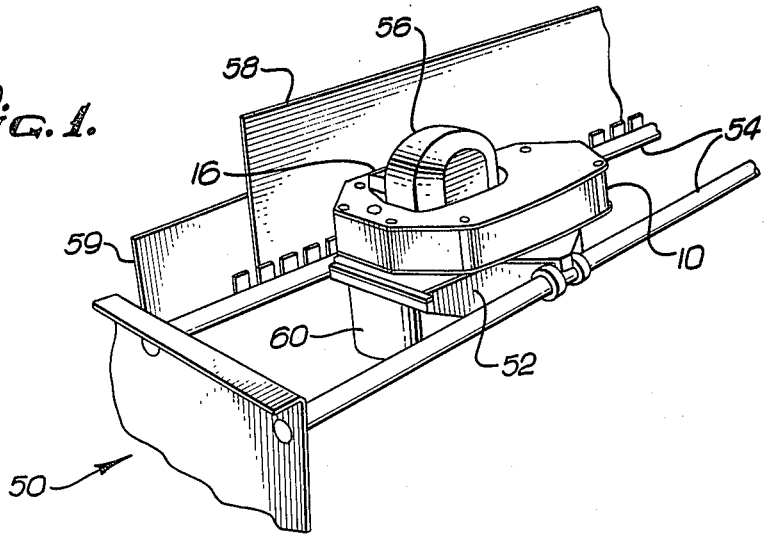
FIG. 1 is a perspective view of a portion of a printer using the ribbon cassette and shield of the present invention.

Referring to FIG. 1, a typical printer 50 includes a shuttle 52 which is moveable along a pair of rails 54 and carries a wire matrix print head 56. The print head 56 prints by activating wires in the matrix to force portions of a ribbon 16 into contact with a printing medium such as paper 58. The paper 58 rests against a platen 59. The ribbon 16 is positioned between the print head 56 and the paper 58 and is part of an endless loop carried within a ribbon cassette 10. The cassette 10 is carried on the shuttle 52 and is coupled to a ribbon drive motor 60 which is used to advance the ribbon within the cassette 10.

Figure 2:
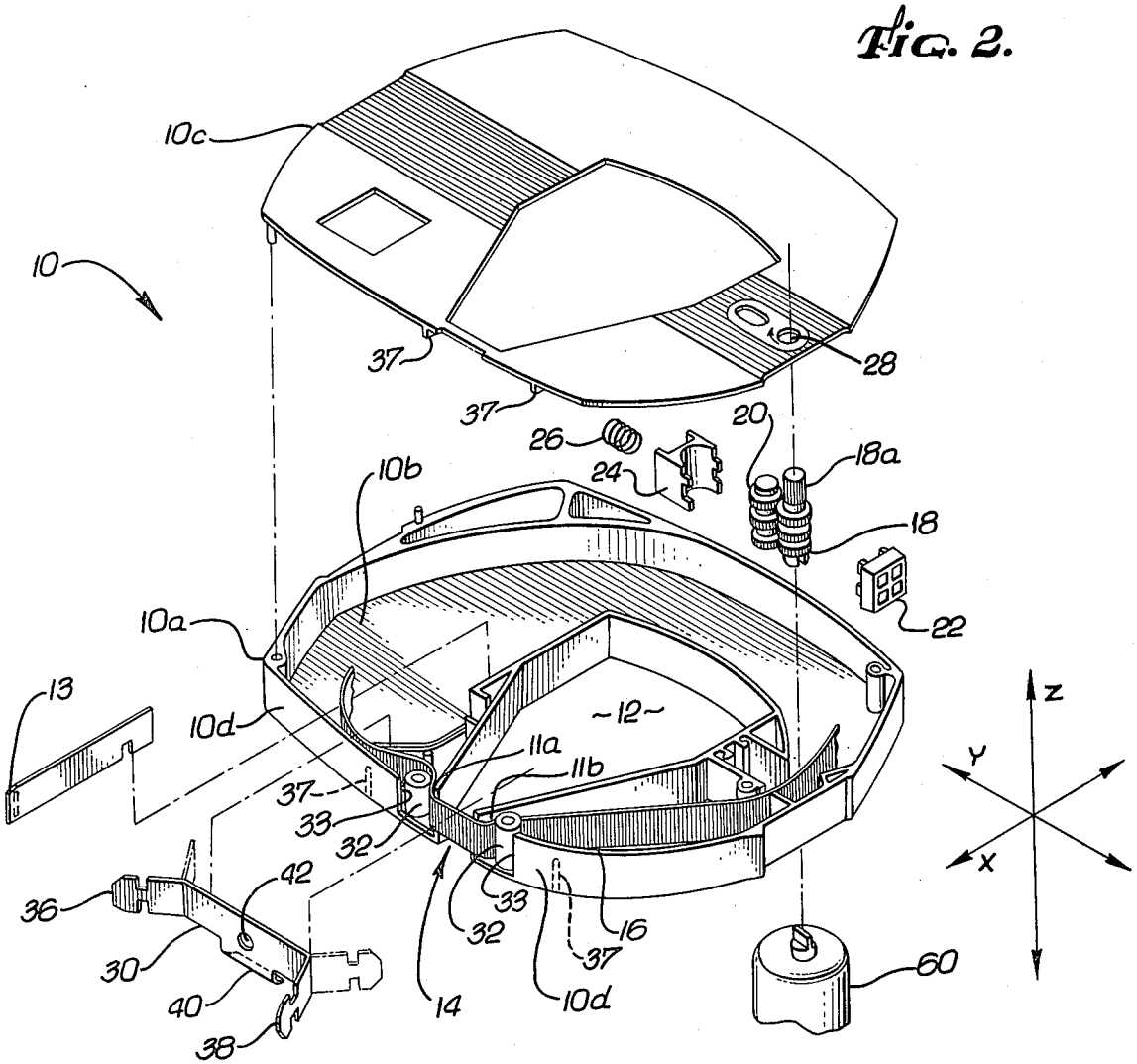
FIG. 2 is a perspective exploded view of the ribbon cassette.

Referring now to FIG. 2, the ribbon cassette includes a housing 10*a* having walls defining a ribbon storage area 10*b* and a central open space 12 for accommodating the print head 56. The space 12 includes a front opening 14 across which the ribbon 16 extends. The housing 10*a* has somewhat of a horseshoe-type shape. A cover 10*c* serves to secure the ribbon 16 within the housing 10*a*. The ribbon 16 exits and enters the housing 10*a* via a pair of slots 11*a* and 11*b* adjacent the opening 14. Ribbon tension is provided by a tension spring 13 located adjacent to the exit slot 11*a*.

The drive motor 60 is coupled to a sprocket 18 which includes a manual adjustment knob 18*a* which extends through an opening 28 in the top 10*c* of the ribbon cassette. The sprocket 18 engages a second sprocket 20, and rotation of the sprockets 18 and 20 draws the ribbon 16 through the sprockets and into the ribbon storage area 10*b*. The sprockets 18 and 20 are held in place by means of a pair of brackets 22 and 24 and a spring 26.

A ribbon shield 30 is carried within the cassette housing 10*a* and serves to prevent the wicking or smudging of ink from the ribbon 16 to the paper 58. The ends of the ribbon shield 30 fit within slots 33 adjacent to a pair of ribbon guides 32. The ribbon shield 30 is held in a fixed position on the y and z axes by means of tabs 37 which are molded into the housing 10*a* and cover 10*c*. The ribbon shield 30 includes a pair of forwardly angled notched end portions 36 and 38 which extend into the slots 33. The ribbon shield 30 also includes a lower portion 40 which is curved rearwardly in order to accomodate motion of the paper 58 as it initially moves past the ribbon cassette 10. In addition, the ribbon shield includes a central opening 42 through which the ribbon 16 can extend in order to accomplish printing. The ribbon shield 30 is made of a relatively flexible material, such as polypropylene having a thickness on the order of 0.010 inches, and the end portions 36 and 38 are flexed rearwardly and biased against the inside of the front wall 10*d* of the housing in order to secure the ribbon shield 30 across the opening 14 by means of spring-like tension. The tension causes the shield 30 to bow outwardly along the x axis. During operation, the bowed portion will contact the paper and force it flat against the platen 59, thereby isolating the ribbon from the paper. Without the pressure provided by the ribbon shield, the paper would have a tendency to billow outwardly from the platen thereby increasing the risk of unwanted contact with the ribbon through the opening 42.

Figure 3:
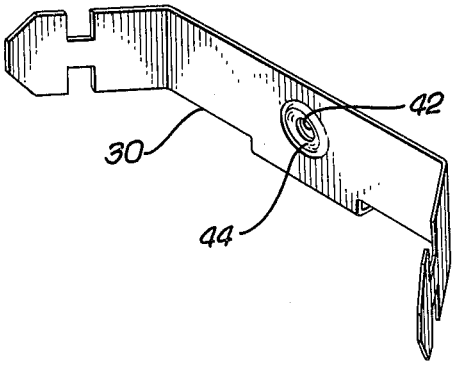
FIG. 3 is a perspective view of an alternate embodiment of the ribbon shield of the present invention.
Figure 4:
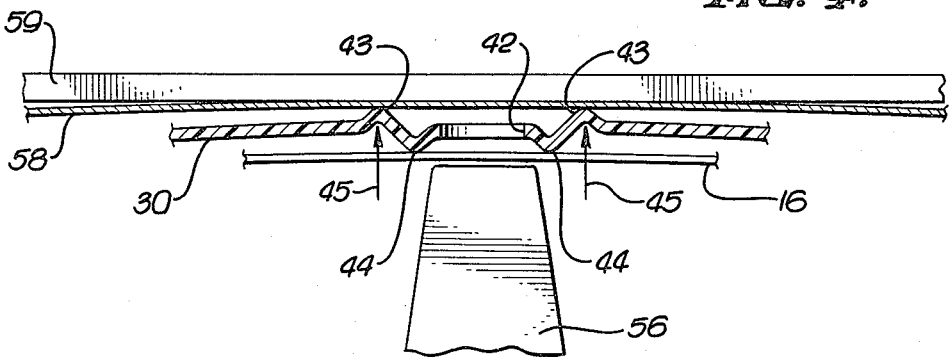
FIG. 4 is a top plan view of a portion of the shield of FIG. 3 showing it in place within a printer.
Figure 5:
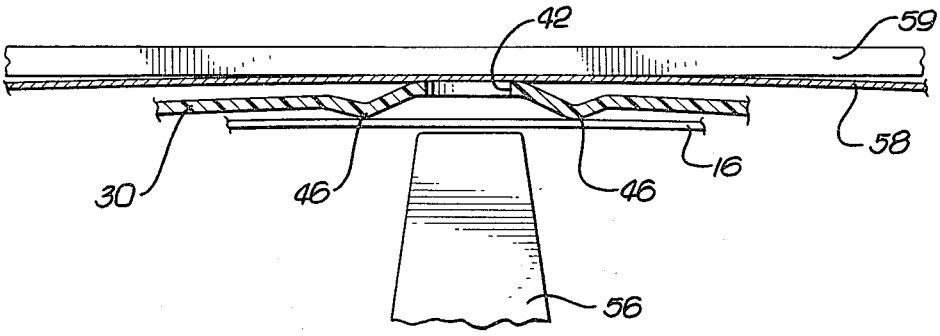
FIG. 5 is a top plan view of another alternate embodiment of the ribbon shield of the present invention.

Referring now to FIGS. 3–5, smudging between the ribbon and paper can be further reduced by modifying the ribbon shield of FIG. 2 to incorporate one or more raised rings which surround the opening 42. The shield shown in FIGS. 3 and 4 has a pair of annular rings 43 and 44. The tension on the shield 30 when mounted in a cassette housing causes it to bow in the direction indicated by arrows 45, i.e., toward the paper and platen. The bowing causes the outer ring 43 to press the paper into contact with the platen, while the inner ring 44 spaces the ribbon 16 a short distance from the opening 42. Note that the portion of the shield 30 in the area of the opening 42 does not contact either the ribbon or the paper. In the alternate design shown in FIG. 5, a single ring 46 is utilized, and the surface of the shield in the area of the opening 42 directly contacts the paper. The inner ring 46 serves to maintain the ribbon a slight distance from the opening 42 when printing is not in progress. Typical spacings between the paper 58, opening 42 and ribbon 16 are shown in the drawings. Of course, these spacings are illustrative only, and their values could be varied without affecting the performance of the shield. Tests with the shields of FIGS. 3–5 have shown that no smudging of the paper occurs. These tests have also indicated that although a large amount of debris accumulates in the area near the opening 42, almost no debris is built up in the opening itself. The specific configuration of the rings shown in FIGS. 3–5 is illustrative only and the spacing function provided by the rings could also be provided by non-circular ridges or the like.

In summary, the present invention is directed to an improved ribbon shield for use in a ribbon cassette. The ribbon shield is held under tension so as to provide a spring effect which causes it to remain in intimate contact with the paper, thereby pressing the paper flat against the platen. The ribbon shield may be comprised of an elongated flexible strip of polypropylene or similar plastic material and has a pair of forwardly angled end portions. When the end portions are inserted into the cassette housing, they are flexed rearwardly and locked in the housing so as to hold the ribbon shield in tension within the housing. The shield includes a lower curved lead-in surface to accomodate paper motion past the ribbon cassette. The design of the shield enables it to be easily snapped into position within the cassette, thereby covering the exposed length of ribbon where the printing takes place. Because the shield is an integral part of each cassette, the ribbon is always correctly positioned behind the shield, making operator adjustments unnecessary. Because the shield forms part of the ribbon cassette, any ink build-up on the shield will be eliminated when the cassette is discarded and a new one installed. Improved performance may be obtained by incorporating one or more annular rings in the shield in the area of the central opening.

Although the invention has been described in terms of particular embodiments, variations within the scope of the invention will readily occur to those skilled in the art. The scope of the invention should therefore be determined with reference to the appended claims rather than the foregoing description.

We claim:

1. A ribbon cassette for use with a printer having a platen or the like across which a printing medium moves, comprising:

a housing including an interior section defining a central space for accommodating a printing mechanism such as a printhead and a front opening exposing the central space to the front of the housing, said housing for containing the bulk of an endless loop of ribbon and including a slot on each side of the interior section, a portion of said ribbon passing through said slots and spanning the front opening; and a ribbon shield made of a flexible strip of material, said ribbon shield including a central section covering the portion of the ribbon which spans the front opening to prevent contact between the ribbon and a printing medium, a pair of end sections which extend into the slots to position the ribbon shield with respect to the housing, and an aperture in the central section through which the ribbon can be pushed to contact the printing medium, wherein said shield is maintained under tension to cause the central section to bow outward from said front opening away from the central space, and wherein the central section is maintained unconnected to the housing to thereby enable it to flex said shield forcing the printing medium flat against the platen of the printer.

2. The ribbon cassette of claim 1 wherein the housing includes a pair of ribbon guides, one positioned near each of the slots, wherein the ribbon extends through the slots on one side of the ribbon guides and the end portions of the shield extend through the slots on the opposite side of the ribbon guides, said end sections being normally forwardly angled with respect to the plane of the central section and flexed when inserted into the housing to thereby secure the shield within the housing, said flexing causing the shield to be maintained under tension.

3. The ribbon cassette of claim 1 wherein the ribbon shield is made of polypropylene.

4. A ribbon shield for use in a printer which employs a ribbon cassette of the type having a housing for containing the bulk of an endless loop ribbon, said housing having interior walls defining a central space for accommodating a printhead or the like, said central space having a front opening across which an exposed portion of the ribbon extends, said ribbon shield comprising:

an elongated strip of flexible material including a central section having an aperture therein for the passage of the ribbon during printing, a pair of end sections which are angled with respect to the plane of the central section, wherein when the ribbon shield is attached to the cassette, the central section shields the exposed portion of the ribbon from a printing medium, and the end sections extend into the housing and are flexed to cause the central section to flex away from the central space, said flexed central section being maintained unconnected to the housing to thereby force said printing medium into close contact with a platen in the printer.

5. The apparatus of claims 1 or 4 further including a guide section adjacent to the edge of central section which the printing medium initially passes, said guide section curving toward the central space of 5 the ribbon cassette when the shield is in position, said guide section facilitating smooth movement of the printing medium past the shield.

6. The apparatus of claims 1 or 4 wherein the central section includes at least one ridge adjacent the aperture, said ridge spacing the ribbon from the surface of the shield immediately adjacent the aperture to prevent ink build-up within the aperture.

7. The apparatus of claim 6 including a single ridge which comprises a ring surrounding the aperature wherein said ring faces the ribbon and spaces the ribbon from the aperature, the surface of the shield adjacent the aperture contacting the printing medium.

8. The apparatus of claim 6 including two ridges, one on each side of the shield, each comprising a ring surrounding said aperture said rings spacing both the ribbon and printing medium away from the aperture.

* * * * *